US012011077B2

(12) United States Patent
Yang

(10) Patent No.: US 12,011,077 B2
(45) Date of Patent: Jun. 18, 2024

(54) SHELL DEVICE FOR COSMETIC STORAGE CONTAINER

(71) Applicant: SHYA HSIN PACKAGING INDUSTRY (CHINA) CO., LTD., Kunshan (CN)

(72) Inventor: Haiying Yang, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 0 days.

(21) Appl. No.: 18/023,736

(22) PCT Filed: Jun. 29, 2021

(86) PCT No.: PCT/CN2021/103211
§ 371 (c)(1),
(2) Date: Feb. 28, 2023

(87) PCT Pub. No.: WO2022/227262
PCT Pub. Date: Nov. 3, 2022

(65) Prior Publication Data

US 2023/0337807 A1 Oct. 26, 2023

(30) Foreign Application Priority Data

Apr. 25, 2021 (CN) ..... 202110447536.8

(51) Int. Cl.
*A45D 40/06* (2006.01)

(52) U.S. Cl.
CPC ..... *A45D 40/06* (2013.01); *A45D 40/065* (2013.01)

(58) Field of Classification Search
CPC ..... A45D 40/06; A45D 40/065
(Continued)

(56) References Cited

U.S. PATENT DOCUMENTS 4,993,857 A 2/1991 Ohba
11,246,394 B2 * 2/2022 Liu ..... A45D 40/06
(Continued)

FOREIGN PATENT DOCUMENTS

CN 110876525 A 3/2020
CN 211242059 U 8/2020
(Continued)

*Primary Examiner* — Jennifer C Chiang
(74) *Attorney, Agent, or Firm* — Bayramoglu Law Offices LLC

(57) ABSTRACT

A shell device for a cosmetic storage container includes a movable cylindrical portion, a rotatable cylindrical portion axially provided with a cutting groove, and a spiral barrel. A guiding protrusion is provided on an outer sidewall of the movable cylindrical portion. The movable cylindrical portion is movably provided in the rotatable cylindrical portion. The guiding protrusion is movably positioned in the cutting groove. The guiding protrusion is movably positioned in a spiral groove formed in an inner wall of the spiral barrel. The bottom of the spiral barrel is sleeved outside the rotatable cylindrical portion. The spiral barrel and the rotatable cylindrical portion rotate relative to each other in a circumferential direction, and are positioned relative to each other in an axial direction. A first spiral guideway is provided in the spiral groove. A second spiral guideway is provided at the outer side of the guiding protrusion.

3 Claims, 3 Drawing Sheets

(58) Field of Classification Search
USPC ..... 401/77–78
See application file for complete search history.

(56) References Cited

U.S. PATENT DOCUMENTS

| | | | | |
|---|---|---|---|---|
| 2002/0053352 | A1 | 5/2002 | Ohba et al. | |
| 2006/0067781 | A1* | 3/2006 | Pleil ..... | A45D 40/065<br>401/116 |

FOREIGN PATENT DOCUMENTS

| | | | | |
|---|---|---|---|---|
| CN | 112315169 | A | | 2/2021 |
| CN | 116530766 | A | * | 8/2023 |

* cited by examiner

SHELL DEVICE FOR COSMETIC STORAGE CONTAINER

CROSS REFERENCE TO THE RELATED APPLICATIONS

This application is the national phase entry of International Application No. PCT/CN2021/103211, filed on Jun. 29, 2021, which is based upon and claims priority to Chinese Patent Application No. 202110447536.8, filed on Apr. 25, 2021, the entire contents of which are incorporated herein by reference.

TECHNICAL FIELD

The present disclosure relates to storage containers, particularly to a shell device for a stick-like cosmetic storage container such as a lipstick tube, a lip balm tube, an eyeshadow stick, a foundation stick, a perfume bottle, and a lotion bottle.

BACKGROUND

The prior storage container such as a lipstick tube includes a movable cylindrical portion, a rotatable cylindrical portion, and a spiral barrel that are sleeved sequentially and movably from inside to outside. Through a cutting groove formed axially in the rotatable cylindrical portion, a guiding protrusion on an outer wall of the movable cylindrical portion, and a spiral groove in the spiral barrel, the movable cylindrical portion extends or retracts freely in the rotatable cylindrical portion. Specifically, the movable cylindrical portion is movably provided in the rotatable cylindrical portion. The guiding protrusion is movably positioned in the cutting groove. The guiding protrusion is movably positioned in the spiral groove. The bottom of the spiral barrel is clamped with and sleeved outside the rotatable cylindrical portion. The spiral barrel and the rotatable cylindrical portion can rotate relative to each other in a circumferential direction, and the spiral barrel and the rotatable cylindrical portion can be positioned relative to each other in an axial direction. In this way, when the rotatable cylindrical portion rotates relative to the spiral barrel, the movable cylindrical portion can be axially displaced to extend out of or retract into the rotatable cylindrical portion. However, due to a large sliding gap between the spiral groove and the guiding protrusion, such a structure is loose and low-end and has an unsmooth operation.

SUMMARY

Given the above defects, the present disclosure provides a shell device for a cosmetic storage container, which achieves a compact structure, a desirable hand feel, smooth and stable operation, and a low cost in use.

To solve the technical problem, the present disclosure adopts the following technical solutions: A shell device for a cosmetic storage container includes a movable cylindrical portion, a rotatable cylindrical portion, and a spiral barrel sequentially from inside to outside. A cutting groove is formed axially in the rotatable cylindrical portion. A guiding protrusion is provided on an outer sidewall of the movable cylindrical portion. The movable cylindrical portion is movably provided in the rotatable cylindrical portion. The guiding protrusion is movably positioned in the cutting groove. A spiral groove is formed in an inner wall of the spiral barrel. The guiding protrusion is movably positioned in the spiral groove. A bottom of the spiral barrel is clamped with and sleeved outside the rotatable cylindrical portion. The spiral barrel and the rotatable cylindrical portion can rotate relative to each other in a circumferential direction, and the spiral barrel and the rotatable cylindrical portion can be positioned relative to each other in an axial direction. In this way, when the rotatable cylindrical portion rotates relative to the spiral barrel, the movable cylindrical portion can be axially displaced to extend out of or retract into the rotatable cylindrical portion. A first spiral guideway is provided in the spiral groove. A second spiral guideway is provided at the outer side of the guiding protrusion. The second spiral guideway is exactly and movably provided in the first spiral guideway, namely the second spiral guideway can slide freely in the first spiral guideway, thereby increasing the contact area between the guiding protrusion and the spiral groove and increasing sliding stability.

As a further technical solution to the present disclosure, the first spiral guideway is concave, while the second spiral guideway is convex.

As a further technical solution to the present disclosure, the first spiral guideway is convex, while the second spiral guideway is concave.

As a further technical solution to the present disclosure, the movable cylindrical portion, the rotatable cylindrical portion, and the spiral barrel are made of the same plastic material.

As a further technical solution to the present disclosure, the movable cylindrical portion, the rotatable cylindrical portion, and the spiral barrel are made of a polyethylene terephthalate (PET) material.

The present disclosure achieves the following beneficial effects: The present disclosure includes a movable cylindrical portion, a rotatable cylindrical portion axially provided with a cutting groove, and a spiral barrel sequentially from inside to outside. A guiding protrusion on an outer wall of the movable cylindrical portion is movably positioned in the cutting groove. The guiding protrusion is then movably positioned in a spiral groove in the inner wall of the spiral barrel. The bottom of the spiral barrel is clamped with and sleeved outside the rotatable cylindrical portion. The spiral barrel and the rotatable cylindrical portion can rotate relative to each other in a circumferential direction while causing no displacement in an axial direction. In this way, when the rotatable cylindrical portion rotates relative to the spiral barrel, the movable cylindrical portion can be axially displaced to extend out of or retract into the rotatable cylindrical portion. A first spiral guideway is provided in the spiral groove. A second spiral guideway is provided at the outer side of the guiding protrusion. The second spiral guideway is exactly and movably provided in the first spiral guideway, namely the second spiral guideway can slide freely in the first spiral guideway. Therefore, the present disclosure achieves a compact structure, a desirable hand feel, smooth and stable operation, and a low cost in use.

DETAILED DESCRIPTION OF THE EMBODIMENTS

Figure 1:
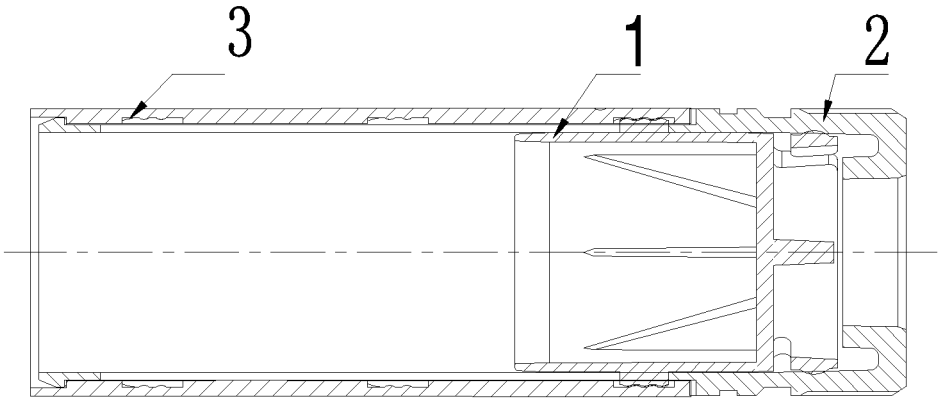
FIG. 1 is a first schematic structural view according to the present disclosure (a movable cylindrical portion retracts into a bottom of a rotatable cylindrical portion)
Figure 2:
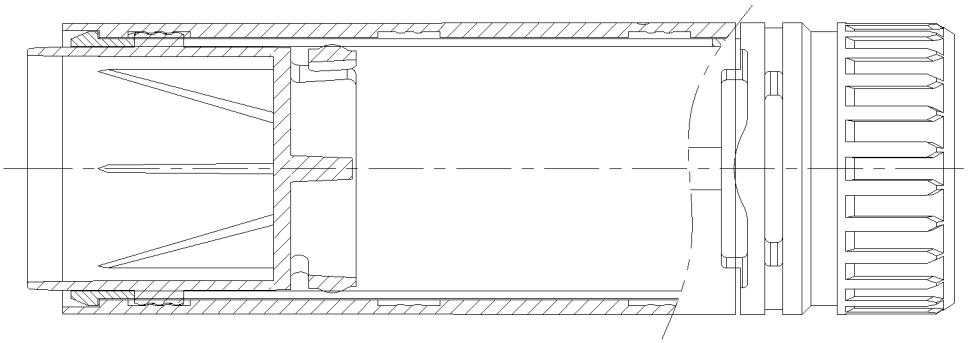
FIG. 2 is a second schematic structural view according to the present disclosure (a semi-sectional view, a movable cylindrical portion extends out of an opening of a rotatable cylindrical portion)
Figure 3:
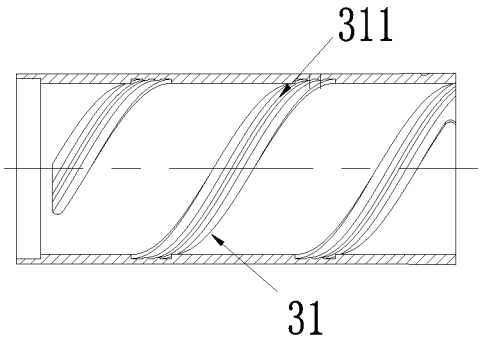
FIG. 3 is a schematic view of a spiral barrel according to the present disclosure.
Figure 4:
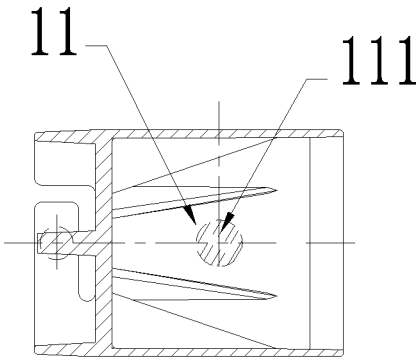
FIG. 4 is a schematic view of a movable cylindrical portion according to the present disclosure.
Figure 5:
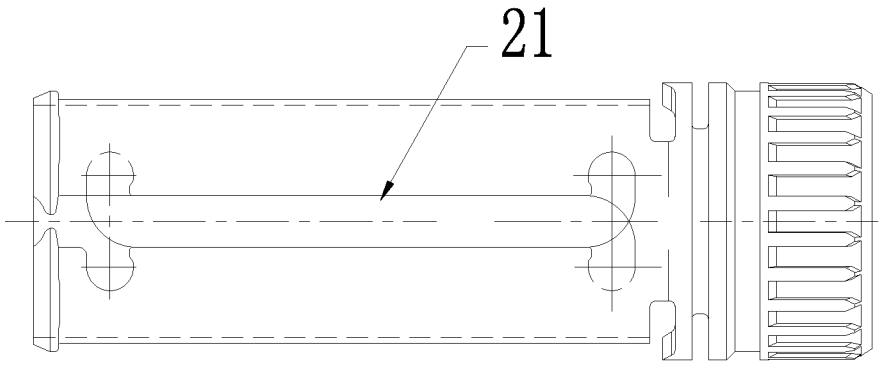
FIG. 5 is a schematic view of a rotatable cylindrical portion according to the present disclosure.

Embodiment: A shell device for a cosmetic storage container includes movable cylindrical portion 1, rotatable cylindrical portion 2, and spiral barrel 3 sequentially from inside to outside. Cutting groove 21 is formed axially in the rotatable cylindrical portion 2. Guiding protrusion 11 is provided on an outer sidewall of the movable cylindrical portion 1. The movable cylindrical portion 1 is movably provided in the rotatable cylindrical portion 2. The guiding protrusion 11 is movably positioned in the cutting groove 21. Spiral groove 31 is formed in the inner wall of the spiral barrel 3. The guiding protrusion 11 is movably positioned in the spiral groove 31. The bottom of the spiral barrel 3 is clamped with and sleeved outside the rotatable cylindrical portion 2. The spiral barrel 3 and the rotatable cylindrical portion 2 can rotate relative to each other in a circumferential direction, and the spiral barrel 3 and the rotatable cylindrical portion 2 can be positioned relative to each other in an axial direction. In this way, when the rotatable cylindrical portion 2 rotates relative to the spiral barrel 3, the movable cylindrical portion 1 can be axially displaced to extend out of or retract into the rotatable cylindrical portion. First spiral guideway 311 is provided in the spiral groove 31. Second spiral guideway 111 is provided at the outer side of the guiding protrusion 11. The second spiral guideway is exactly and movably provided in the first spiral guideway 311, namely the second spiral guideway can slide freely in the first spiral guideway, thereby increasing the contact area between the guiding protrusion 11 and the spiral groove 31 and increasing sliding stability.

The first spiral guideway is concave, while the second spiral guideway is convex. Or, the first spiral guideway is convex, while the second spiral guideway is concave.

The movable cylindrical portion 1, the rotatable cylindrical portion 2, and the spiral barrel 3 are made of the same plastic material, such as a PET material.

The present disclosure has the following action process: When the rotatable cylindrical portion rotates relative to the spiral barrel, since the guiding protrusion 11 is movably positioned in the cutting groove 21, the guiding protrusion 11 slides in the spiral groove 31, and the movable cylindrical portion can be axially displaced to extend out of or retract into the rotatable cylindrical portion. Meanwhile, the second spiral guideway also slides freely in the first spiral guideway, which can increase the contact area between the guiding protrusion 11 and the spiral groove 31 and increase the sliding stability.

What is claimed is:

1. A shell device for a cosmetic storage container, comprising a movable cylindrical portion, a rotatable cylindrical portion, and a spiral barrel sequentially from inside to outside, wherein a cutting groove is formed axially in the rotatable cylindrical portion; a guiding protrusion is provided on an outer sidewall of the movable cylindrical portion; the movable cylindrical portion is movably provided in the rotatable cylindrical portion; the guiding protrusion is movably positioned in the cutting groove; a spiral groove is formed in an inner wall of the spiral barrel; the guiding protrusion is movably positioned in the spiral groove; a bottom of the spiral barrel is clamped with and sleeved outside the rotatable cylindrical portion; the spiral barrel and the rotatable cylindrical portion rotate relative to each other in a circumferential direction, and the spiral barrel and the rotatable cylindrical portion are positioned relative to each other in an axial direction; a first spiral guideway is provided in the spiral groove; a second spiral guideway is provided at an outer side of the guiding protrusion; and the second spiral guideway is exactly and movably provided in the first spiral guideway.

2. The shell device for the cosmetic storage container according to claim 1, wherein the movable cylindrical portion, the rotatable cylindrical portion, and the spiral barrel are made of a same plastic material.

3. The shell device for a cosmetic storage container according to claim 2, wherein the movable cylindrical portion, the rotatable cylindrical portion, and the spiral barrel are made of a polyethylene terephthalate (PET) material.

* * * * *